US011737616B2

(12) United States Patent
Williams et al.

(10) Patent No.: US 11,737,616 B2
(45) **Date of Patent: *Aug. 29, 2023**

(54) DISPENSERS FOR WET-ON-DEMAND SUBSTRATES

(71) Applicant: GOJO Industries, Inc., Akron, OH (US)

(72) Inventors: Kinsley N. Williams, Charlevoix, MI (US); Edward Valle, Akron, OH (US); Jonathan M. Johnson, Akron, OH (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/574,699

(22) Filed: Jan. 13, 2022

(65) Prior Publication Data

US 2022/0133099 A1 May 5, 2022

Related U.S. Application Data

(63) Continuation of application No. 16/843,960, filed on Apr. 9, 2020, now Pat. No. 11,224,315.
(Continued)

(51) Int. Cl.
*A47K 10/38* (2006.01)
*B05B 9/04* (2006.01)
(Continued)

(52) U.S. Cl.
CPC ..... *A47K 10/38* (2013.01); *B05B 9/0403* (2013.01); *B05B 12/12* (2013.01); *A47K 2010/328* (2013.01)

(58) Field of Classification Search
CPC ..... A47K 10/38
(Continued)

(56) References Cited

U.S. PATENT DOCUMENTS 4,667,846 A 5/1987 Marceau
5,829,278 A 11/1998 Koo
(Continued)

FOREIGN PATENT DOCUMENTS

CN 2728389 Y 9/2005
DE 29809967 U1 12/1998
(Continued)

OTHER PUBLICATIONS

International Search Report and Written Opinion from PCT/US2020/027364 dated Aug. 24, 2020.

*Primary Examiner* — Gene O Crawford
*Assistant Examiner* — Ayodeji T Ojofeitimi
(74) *Attorney, Agent, or Firm* — Calfee, Halter & Griswold LLP

(57) ABSTRACT

Exemplary embodiments wet-on-demand dispensers are disclosed herein. An exemplary dispenser for dispensing wet-on-demand substrates includes a housing, a container for holding a fluid, one or more wetting tips in fluid communication with the container. Each of the one or more wetting tips has a movable valve member. The exemplary dispenser further includes a holder for holding a roll of substrate and the movable valve members are moved as a function of contact with the substrate.

20 Claims, 8 Drawing Sheets

Related U.S. Application Data

(60) Provisional application No. 62/832,308, filed on Apr. 11, 2019.

(51) Int. Cl.
*B05B 12/12* (2006.01)
*A47K 10/32* (2006.01)

(58) Field of Classification Search
USPC ..... 221/33–63
See application file for complete search history.

(56) References Cited

U.S. PATENT DOCUMENTS

| | | | | |
|---|---|---|---|---|
| 6,314,971 | B1 | 11/2001 | Schneider | |
| 6,343,491 | B1 | 2/2002 | Jung | |
| 7,856,941 | B2 | 12/2010 | Nelson et al. | |
| 11,224,315 | B2 * | 1/2022 | Williams | A47K 10/38 |
| 2009/0101665 | A1 | 4/2009 | Mulhelm | |
| 2010/0032443 | A1 | 2/2010 | Mueller et al. | |

FOREIGN PATENT DOCUMENTS

| | | | |
|---|---|---|---|
| DE | 102006036772 | A1 | 2/2008 |
| EP | 550863 | A1 | 7/1993 |

* cited by examiner

DISPENSERS FOR WET-ON-DEMAND SUBSTRATES

RELATED APPLICATIONS

The present application is a continuation of U.S. patent application Ser. No. 16/843,960, filed on Apr. 9, 2020, which claims the benefit of and priority to U.S. Provisional Patent Application No. 62/832,308, filed on Apr. 11, 2019, both of which are incorporated herein by reference in their entirety.

TECHNICAL FIELD

The present invention generally relates to dispensers for dispensing wet-on-demand substrates, such as, for example, wipes, moist towelettes, wet paper towels or the like. More particularly, the present invention relates to dispensers having rolls of dry substrates, such as, for example wipes, towelettes, paper towels or the like and components for wetting sheets of the dry substrates when they are dispensed.

BACKGROUND OF THE INVENTION

Substrates, such as wipes and towelettes are typically made from a variety of materials, such as non-woven materials. Wipes and towelettes are often pre-moistened with solutions, such as, for example, antimicrobial solutions. In some embodiments, wipes are arranged in a roll and placed in a container that includes a fluid or moistening solution. The moistening solution wicks up the wipes and saturates the entire roll of wipe material. When a wipe is needed, the user pulls a pre-moistened wipe from the container. Because the moistening solution typically contains compounds, such as, for example, water and/or alcohol, the moistening solution is prone to evaporation. Often, especially in low-use scenarios, the moistening solution evaporates over time. Accordingly, when a user obtains a wipe, the wipe is not sufficiently moistened and/or is completely dry, which is referred to as "dry-out."

SUMMARY

Exemplary embodiments of wet-on-demand dispensers are disclosed herein. An exemplary wet-on-demand dispenser includes a housing, a container for holding a fluid, one or more wetting tips, one or more movable valve members, and one or more conduits placing the one or more wetting tips in fluid communication with the container. The exemplary dispenser further includes a roll of substrate. One or more sheets of substrate are dispensed from the dispenser and when the one or more sheets of substrate are dispensed form the dispenser, the one or more sheets of substrate contact the one or more movable valve members and move the one or more movable valve members to an open position to allow fluid to flow out of the one or more wetting tips.

An exemplary dispenser for dispensing wet-on-demand substrates includes a housing, a container for holding a fluid, one or more wetting tips in fluid communication with the container. Each of the one or more wetting tips has a movable valve member. The exemplary dispenser may further include a holder for holding a roll of substrate and the movable valve members are moved as a function of contact with the substrate.

Another exemplary dispenser for dispensing wet-on-demand substrates includes a housing, a container for holding a fluid, on or more wetting tips in fluid communication with the container. Each of the wetting tips has a movable valve member. The exemplary dispenser further includes a holder for holding a roll of substrate and the movable valve members are moved as a function of contact with the substrate and movement of the movable valve members in an upward direction cause fluid to be dispensed on the substrate.

Another exemplary dispenser for dispensing wet-on-demand substrates includes a housing, a first container for holding a concentrated fluid, a second container for holding a diluent, a mixing chamber for mixing the concentrated fluid and the diluent, and one or more wetting tips in fluid communication with the mixing, each of which have a movable valve member. In addition, the dispenser includes a holder for holding a roll of substrate. In addition, the movable valve members are moved as a function of contact with the substrate.

Another exemplary dispenser for dispensing wet-on-demand substrates includes a housing, a container for holding a fluid. a header in fluid communication with the container and a plurality of wetting tips in fluid communication with the header. Each of the wetting tips has a movable valve member that are moved as a function of contact with the substrate to dispense fluid onto the substrate.

BRIEF DESCRIPTION OF THE DRAWINGS

These and other features and advantages of the present invention will become better understood with regard to the following description, and accompanying drawings where.

DETAILED DESCRIPTION

The exemplary embodiments shown and described herein are for illustrative purposes. Although not all of the components are shown or included in the exemplary embodiments, one of ordinary skill will understand that selected components in one embodiment may be used in the other embodiments. For example, the concepts shown and described with respect to FIG. 11, may be used in any of the dispensers disclosed herein.

Figure 1:
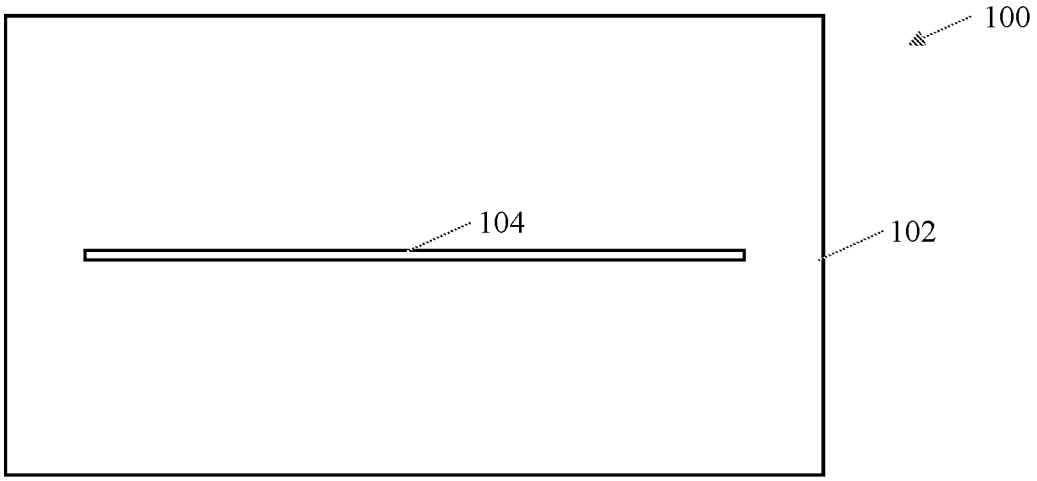
FIG. 1 is simplified front view of an exemplary embodiment of a wet-on-demand dispenser.
Figure 2:
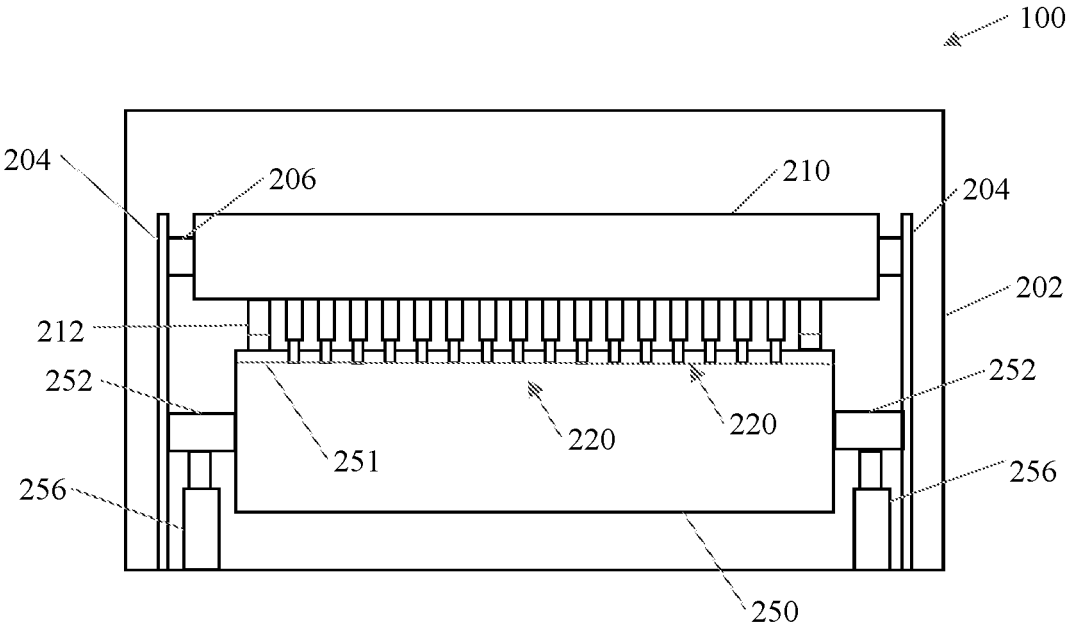
FIG. 2 is a simplified front view of the exemplary wet-on-demand dispenser of FIG. 1 with the cover removed.

FIG. 1 is a front view of an exemplary wet-on-demand dispenser 100. Wet-on-demand dispenser 100 includes a cover 102. A dispensing slot 104 is located in cover 102. In some embodiments, dispensing slot 104 is located in cover 102 at a position that is at a level that is designed for efficient wetting of the substrate being dispensed. In some embodiments, dispensing slot 104 is located in a position that causes the substrate being pulled out of the dispenser to contact one or more wetting tips 220 to wet the substrate. In some embodiments, dispensing slot 104 is located along substantially the same level as the top of the roll of substrate 250 (FIG. 2). In some embodiments, dispensing slot 104 is located along the same level as the bottom of the roll of substrate 250. In some embodiments, one or more rollers (not shown) may be used in the wet-on-demand dispenser 100 to achieve the desired interaction with the wetting tips (220). In some embodiments, a dancer roll (not shown) is used to adjust the tension in the substrate and help facilitate the interaction with the wetting tips.

Wet-on-demand dispenser 100 may be a manual dispenser or a touch-free electronic dispenser. In some embodiments, wet-on-demand dispenser 100 may include one or more mechanisms to provide for the advancement of a single sheet of substrate to be dispensed and provide one or more mechanisms for separating the single sheet from the roll of substrate. In some embodiments, wet-on-demand dispenser 100 includes one or more knives or cutting members (not shown) to separate a sheet of substrates from the roll of substrate. In some embodiments, wet-on-demand dispenser 100 includes a "brake", (not shown) which stops the roll from unrolling when after the sheet is dispensed, so that the sheet may be torn off by physical force without advancing additional sheets of substrate. In some embodiments, one or more pinch rolls are used for holding the substrate when a sheet of substrate is torn off. In some embodiments, the roll of substrate 250 includes perforations (not shown), which provides for easier separation of sheets of substrate from the roll of substrate 250.

Exemplary touch free wet-on-demand dispensers 100 may include one or more of a sensor (now shown), such as, for example, an infrared ("IR") for sensing the presence of an object or user's hand, a power source (not shown), such as, one or more batteries, a processor (not shown), such as, for example, a microprocessor for controlling the operation of the dispenser, memory (not shown), gearing (not shown) for advancing sheets of substrate, and other mechanical or electrical components (not shown) that one of ordinary skill in the art would determine necessary to perform functions required for a dispenser or to perform functions described herein.

FIG. 2 is a simplified illustration of the wet-on-demand dispenser 100 with the cover removed. Wet-on-demand dispenser 100 includes a roll of substrate 250. The substrate may be, for example, a roll of wipes, a roll of towelettes, a roll of paper towels or the like. The roll of substrate 250 is consumable and may be replaced with a new roll when the roll is empty. The roll of substrate 250 is mounted on roller 252.

In this exemplary embodiment, roller 252 is connected to mounting bracket 204 in a manner that allows roller 252 to move up/down in a linear motion. In this exemplary embodiment, biasing members 256 bias roller 252 upward. In this exemplary embodiment, guide wheels 212 are located above the roll of substrate 250 and the guide wheels 212 contact the top of the roll of substrate 250. Biasing members 256 bias roller 252 (and therefore the roll of substrate 250) upward so that the top of the roll of substrate 250 is always located at a fixed position with respect to the one or more wetting tips 220. In some exemplary embodiments, biasing members 256 and guide wheels 212 cause the top of the roll of substrate 250 to be located at substantially the same level as the slot 104 in the cover. In some embodiments, the roll of substrate 250 is biased downward and the sheets of substrate are taken from bottom of the roll of substrate 250.

Located within wet-on-demand dispenser 100 is a container 210 for holding a fluid that is to be dispensed on the substrate as the substrate is being dispensed. In this exemplary embodiment, container 210 is connected to mounting bracket 204 by mounts 206, however, container 210 may be attached to wet-on-demand dispenser 100 in any manner. In fluid communication with container 210 is a plurality of wetting tips 220. In some embodiment, only one wetting tip is used. In such embodiments, the single tip may extend along a substantial portion of the width of the substrate. In this exemplary embodiment, container 210 is located above wetting tips 220 and gravity feeds fluid from the container to the wetting tips 220. However, container 210 may be located anywhere in the dispenser, or on the top of the dispenser. In some embodiments, a pump (not shown) is included that pumps fluid from the container into the one or more wetting tips 220. In some embodiments, container 210 and wetting tips 220 are connected together as a single unit (which may be referred to herein as a "refill unit") that may be inserted and removed from the wet-on-demand dispenser 100. The refill unit 270 may be readily inserted into and removed from wet-on-demand dispenser 100. Thus, an empty refill unit 270 may be removed and replaced with a full refill unit 270. IN some embodiments, the refill unit is container 210 and a fitting (not shown) for placing the interior of the container 210 in fluid communications with one or more wetting tips 220.

Figure 3:
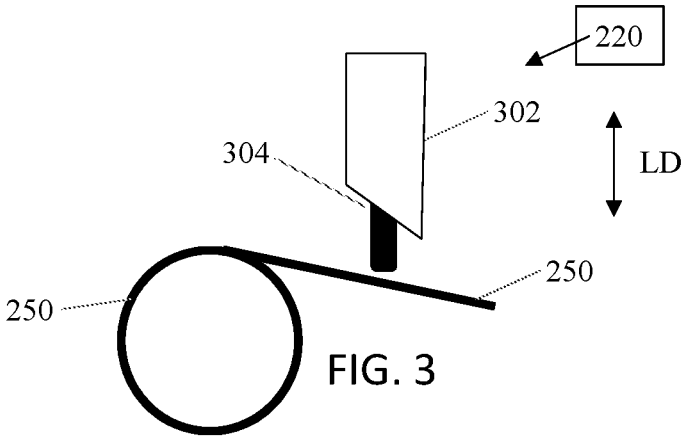
FIGS. 3-4 are simplified exploded views of an exemplary wetting tip for exemplary dispensers.

FIG. 3 illustrates an exemplary wetting tip 220. Wetting tip 220 includes a housing 302 that receives a movable valve member 304 and is in fluid communication with container 220. In this exemplary embodiment, movable valve member 304 moves up and down in a linear direction LD. In some embodiments, gravity holds the movable valve member 304 in its downward position, which is shown in FIG. 3. In some embodiments, a biasing member (not shown), such as, for example, a spring, biases the moveable valve member 304 in the closed position, which in this exemplary embodiment is the downward position. In the closed position, movable valve member 304 prevents fluid from flowing out of housing 302. In the open position (in this case is the upper position shown in FIG. 4), moveable valve member 304 is moved to the open position allowing fluid to flow through moveable valve member 304 or around the outside surface of moveable valve member 304. In some embodiments, moveable valve member 304 is either fully open of fully closed. In some embodiments, moveable valve member 304 controls the volume of fluid flowing past. In some embodiments, the flow is proportional to the amount of movement of the moveable valve member 304, with the maximum flow occurring when movable valve member 304 is in its uppermost, or inward, position.

Figure 4:
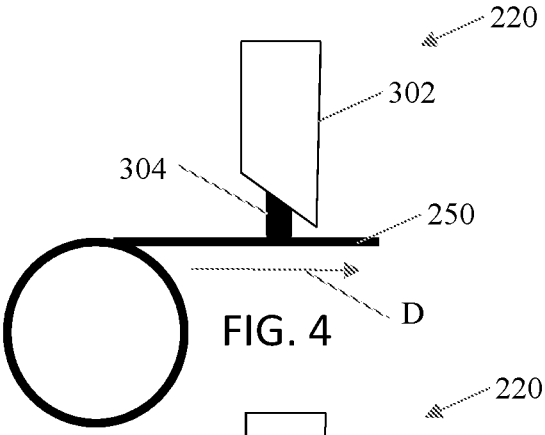

Moveable valve members 304 require either direct contact with the substrate or indirect contact with the substrate to open movable valve members 304 to allow fluid to flow therethrough. As shown in FIG. 3, substrate 250 is at a downward angle and is not contacting moveable valve member 304 and no fluid is flowing. In FIG. 4, substrate 250 is being pulled out at an angle that causes movable valve member 304 to move upward and allow fluid to flow out. As the substrate is pulled out, the substrate is wetted. In some embodiments, a user can control the amount of fluid that is dispensed on the substrate by controlling the speed that the substrate is pulled out of the dispenser. Thus, in some embodiments a user may determine that she would like a dryer sheet of the substrate 250 and pull the sheet out quickly. If she desires a wetter sheet of the substrate 230, she can pull the sheet out slower.

In this exemplary embodiment, substrate 250 is being pulled out of the wet-on-demand dispenser 100 so that the substrate 250 is pulled out of slot 104 at substantially the same level as the top of the roll of substrate 250. In some embodiments, one or more rollers (not shown) may be used to cause the substrate 250 to contact the plurality of wetting tips 220 at one or more desired angles for wetting the surface of the substrate and the dispensing slot 104 may be located at one or more positions that are not substantially level with the top or bottom of the roll of substrate 250. In addition, although wetting tips 220 are located above the sheet of substrate being dispensed, in some embodiments, one or more of the wetting tips 220 are located below or beside the substrate being moistened.

Figure 4A:
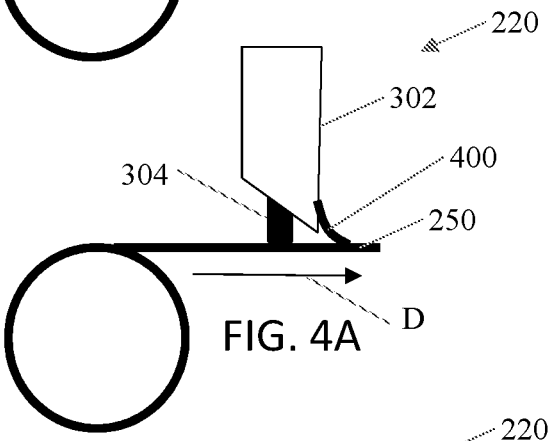
FIG. 4A is a simplified exploded views of an exemplary wetting tip with a difuser for exemplary dispensers.

FIG. 4A illustrates wetting tip 220 with a diffuser 400. Diffuser 400 may spread the fluid being dispensed over a larger area and/or may aid in the consistency of the amount of fluid dispensed on sheets of substrate 250. Diffuser 400 may be attached to the housing 302 of wetting tip 220, to the end of moveable valve ember 304, or to any other appropriate structure of wet-on-demand dispenser. In this exemplary embodiment, diffuser 400 is a rubber "squeegee" type material. In some embodiments, diffuser 400 is a brush. In some embodiments, diffuser 400 is a roller. In some embodiments, the diffuser is an absorbent material, such as, for example, a sponge. In some embodiments, a diffuser 400 is used for individual wetting tips 220. In some embodiments, diffuser 400 is elongated and extends across a plurality of wetting tips 220. In some embodiments, diffuser 400 located on the opposite side of the substrate as the plurality of wetting tips 220. In some embodiments, there is a diffuser 400 on both sides of the substrate. In some embodiments, the diffuser 400 is positioned to prevent liquid from dripping and is used to direct any drips toward the substrate being moistened or wetted.

Figure 5:
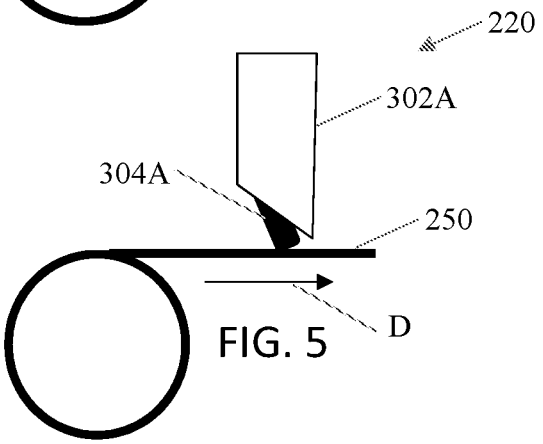
FIG. 5 is a simplified exploded views of an additional exemplary wetting tips for exemplary dispensers.

FIG. 5 illustrates another exemplary embodiment of a wetting tip 220A. Wetting tip 220A includes a housing 302A that receives a movable valve member 304A and is in fluid communication with container 221. In this exemplary embodiment, movable valve member 304A pivots. In some embodiments, gravity holds the movable valve member 304A in its unpivoted position. In some embodiments, a biasing member, such as, for example, a spring, biases the movable vale member 304A to its unpivoted position. In the unpivoted position, movable valve member 304A prevents fluid from flowing out of housing 302. In the pivoted position, moveable valve member 304A is pivoted allowing fluid to flow through moveable valve member 304A or around the outside surface of moveable valve member 304A. In some embodiments, moveable valve member 304A is either fully open of fully closed. In some embodiments, moveable valve member 304A controls the volume of fluid flowing past. In some embodiments, the flow increase in proportion to the degree of pivot of the moveable valve member 304A, preferably with the maximum flow occurring when movable valve member 304 is in its most pivoted position.

The wetting tips 220 are illustrated as being in a single row, however, in some embodiments there are two or more rows of wetting tips 220. In some embodiments, there are two or more rows of wetting tips 220 that are offset from one another, so that the fluid dispensed from the wetting tips 220 in one row is not directly on top of the fluid dispensed from a wetting tip 220 in an upstream row. In some embodiments, only one wetting tip 220 is used and preferably, the one wetting tip extends across substantially all of the substrate being wetted.

During the wetting process, wetting tips 220 contact the substrate that they are dispensing fluid upon. Other types of wetting tips that contact the substrate may be used. For example, the movable valve member may be have a spherical shape and may contact the substrate and roll to wet the surface of the substrate. In some embodiments, the movable valve member has a spherical shape and the movable valve member moves off of a valve seat (not shown) to dispense fluid.

Figure 6:
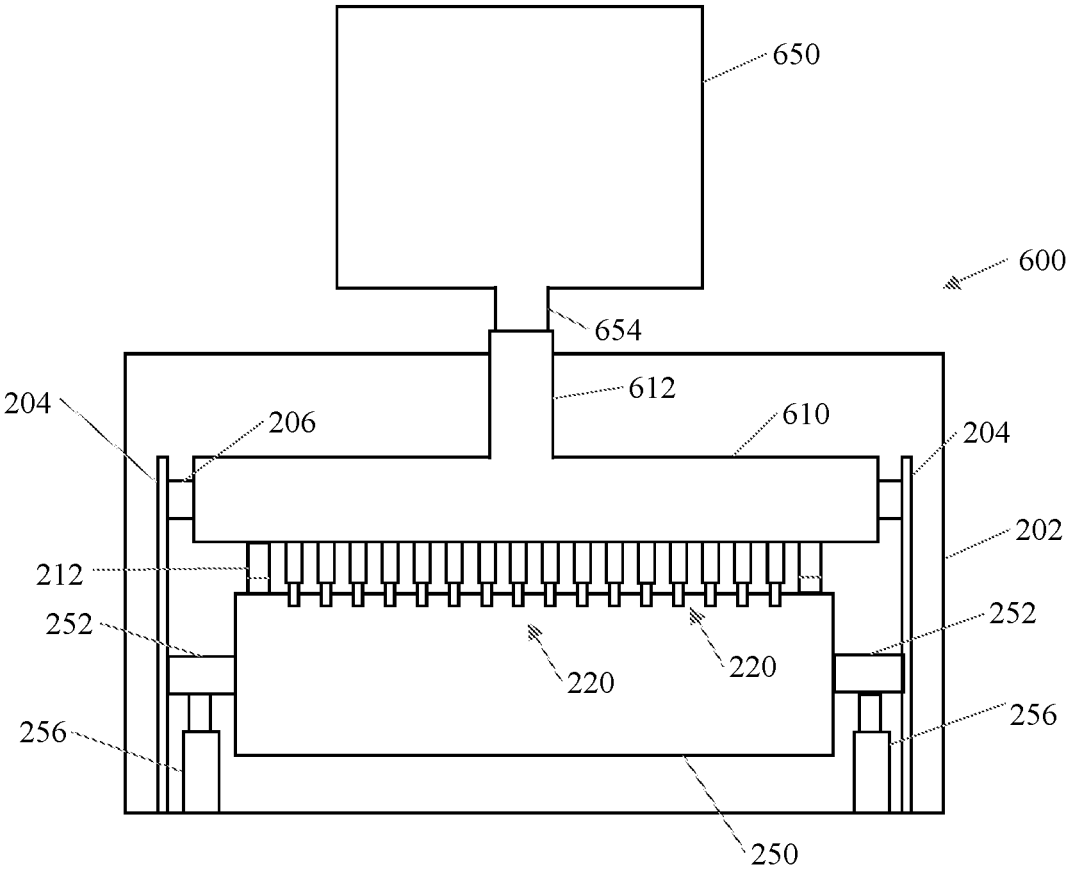
FIG. 6 is a simplified view of another exemplary dispenser with a fluid refilling port and a fluid refilling container connected thereto.

FIG. 6 is another exemplary embodiment of a wet-on-demand dispenser 600. Wet-on-demand dispenser 600 is similar to wet-on-demand dispenser 100 and similar components identified by the same reference numbers and are not re-described with respect to FIG. 6. The wet-on-demand dispenser 600 includes a container 610 that has a plurality of wetting tips 220 in fluid communication therewith. Container 610 also includes a refill conduit 612. FIG. 6 illustrates a refill unit 650 that includes a container 652 and nozzle 654. Nozzle 654 connects to refill conduit 612 to refill container 610. Nozzle 654 and/or neck 612 may contain one or more valves (not shown) or mating valves (not shown) that are closed to prevent leaking of fluid from refill conduit 612 or nozzle 654 an open upon connection between the nozzle 654 and refill conduit 612. In addition, in some embodiments, a cap (not shown) is fitted over refill conduit 612 when the container 610 is not being refilled.

Figure 7:
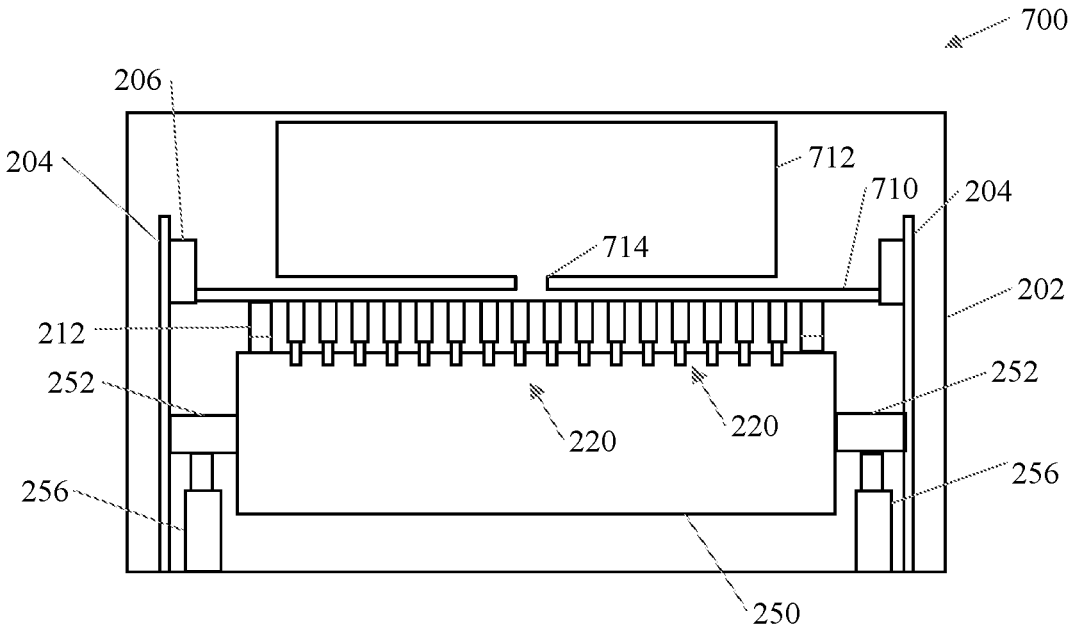
FIG. 7 is a simplified view of another exemplary embodiment of an wet-on-demand dispenser.

FIG. 7 is another exemplary embodiment of a wet-on-demand dispenser 700. Wet-on-demand dispenser 700 is similar to wet-on-demand dispenser 100 and similar components identified by the same reference numbers and are not re-described with respect to FIG. 7. The wet-on-demand dispenser 700 includes a container 712 that includes one or more conduits 714 that supply fluid to a header 710. Header 710 that has a plurality of wetting tips 220 in fluid communication therewith. In some embodiments, header 710 helps provide a more even distribution of fluid on the substrate. In some embodiments, a regulating valve (not shown) is located in conduit 714 to regulate fluid flow into the header. In some embodiments, one or more conduits 714 are sized to control the volume of flow of fluid from container 712 into header 710.

Figure 8:
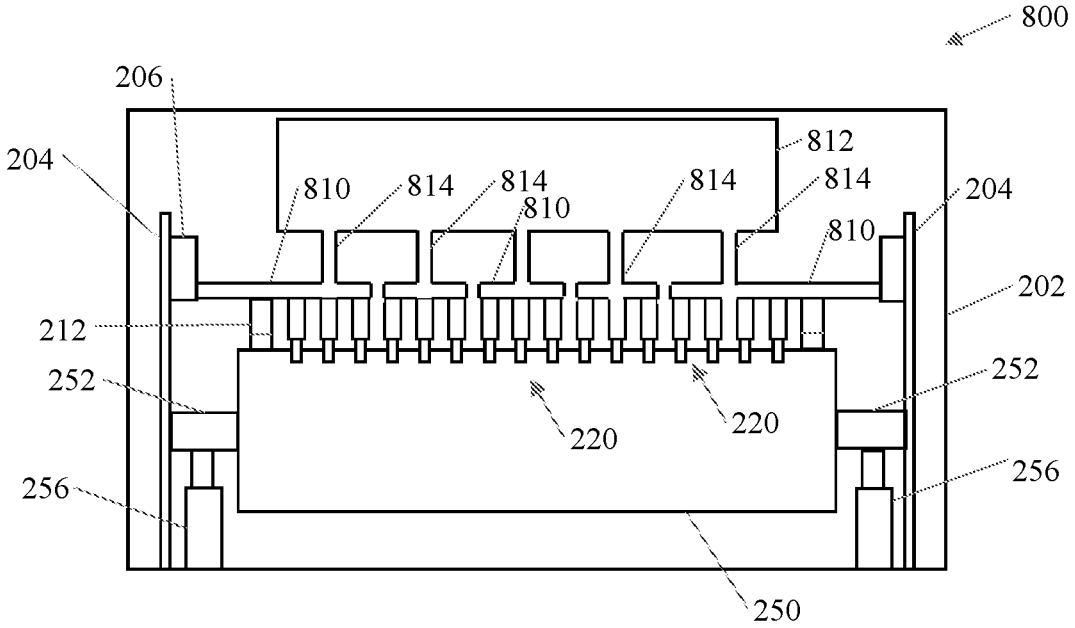
FIG. 8 is a simplified view of another exemplary embodiment of an wet-on-demand dispenser.

FIG. 8 is another exemplary embodiment of a wet-on-demand dispenser 800. Wet-on-demand dispenser 800 is similar to wet-on-demand dispenser 700 and similar components identified by the same reference numbers and are not re-described with respect to FIG. 8. The wet-on-demand dispenser 800 includes a container 812 that includes a plurality of conduits 814 that supply fluid to a plurality of headers 810. Headers 810 have a plurality of wetting tips 220 in fluid communication therewith. In some embodiments, each wetting tip 220 has its own header 810 associated therewith In some embodiments, headers 810 helps provide a more even distribution of fluid on the substrate. In some embodiments, a regulating valve (not shown) is located in conduits 814 to regulate fluid flow into the header. In some embodiments, one or more conduits 814 are sized to control the volume of flow of fluid from container 812 into headers 810.

Figure 9:
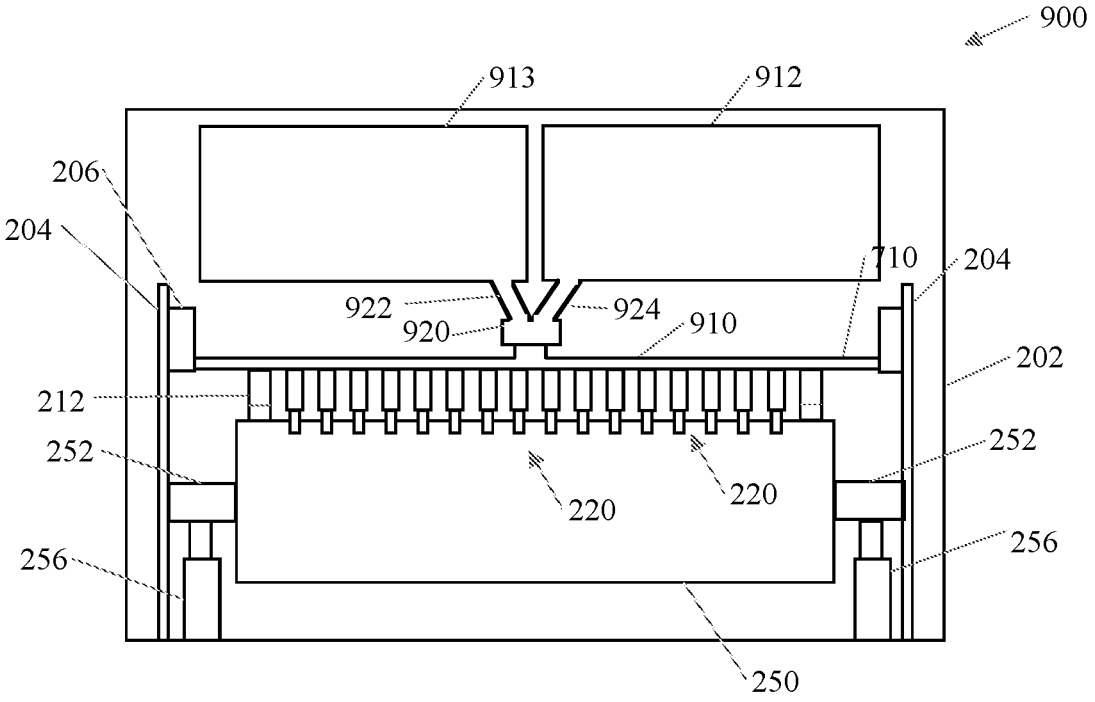
FIG. 9 is a simplified view of another exemplary embodiment of an wet-on-demand dispenser.

FIG. 9 is another exemplary embodiment of a wet-on-demand dispenser 900. Wet-on-demand dispenser 900 is similar to wet-on-demand dispenser 100 and similar components identified by the same reference numbers and are not re-described with respect to FIG. 9. The wet-on-demand dispenser 700 includes a concentrate container 912 and a diluent container 913. In this exemplary embodiment diluent container 913 is filled with water. In some embodiments, diluent container 913 is readily removable from dispenser 900. In some embodiments, diluent container 913 is refillable. Wet-on-demand dispenser 900 includes a mixing chamber 920. A first conduit 922 provides fluid communications between the mixing chamber 920 and diluent container 913 and a second conduit 924 provides fluid communications between the mixing chamber 920 and concentrate container 912. Mixing chamber 920 may include on or more mixing elements, such as, for example, one or more screens, baffles, or the like. In some embodiments, one or more regulating valves (not shown) are incorporated into one or both conduits 922, 924. In some embodiments, a mixing member (not shown) is located in mixing chamber 920. Mixing chamber 920 is in fluid communication with header 910 that has a plurality of wetting tips 220

Figure 10:
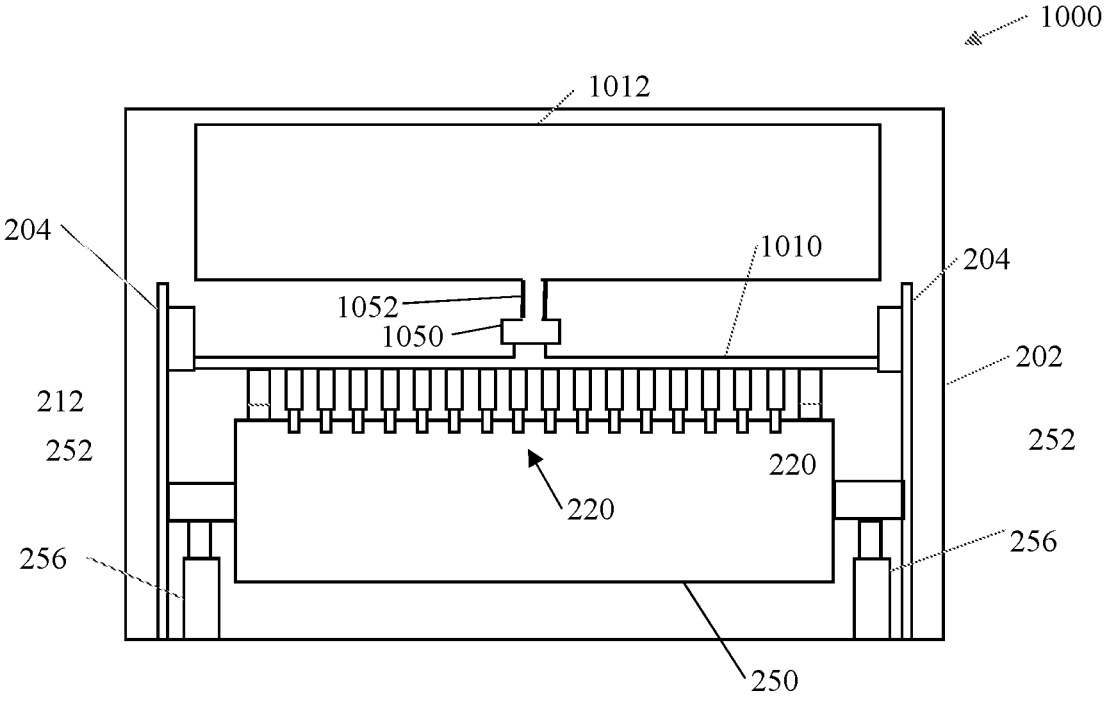
FIG. 10 is a simplified view of another exemplary embodiment of an wet-on-demand dispenser.

FIG. 10 is another exemplary embodiment of a wet-on-demand dispenser 1000. Wet-on-demand dispenser 1000 is similar to wet-on-demand dispenser 100 and similar components identified by the same reference numbers and are not re-described with respect to FIG. 10. The wet-on-demand dispenser 1000 includes a container 1012 that includes one or more conduits or necks 1052 that supply fluid to a header 1010. Header 1010 that has a plurality of wetting tips 220 in fluid communication therewith. Located between container 1012 and header 1010 is controller 1050. Controller 1050 controls the amount of fluid transferred from container 1012 to header 1010. In some embodiments, controller 1050 includes a valve (not shown). In some embodiments, controller 1050 includes a pump (not shown). In some embodiments, controller 1050 includes circuitry (not shown) for measuring the volume of fluid transferred from container 1012 to header 1010. In some embodiments, the amount of fluid transferred to header 1010 is substantially the same as the amount of fluid that is desired to be dispensed onto a sheet of substrate.

Figure 11:
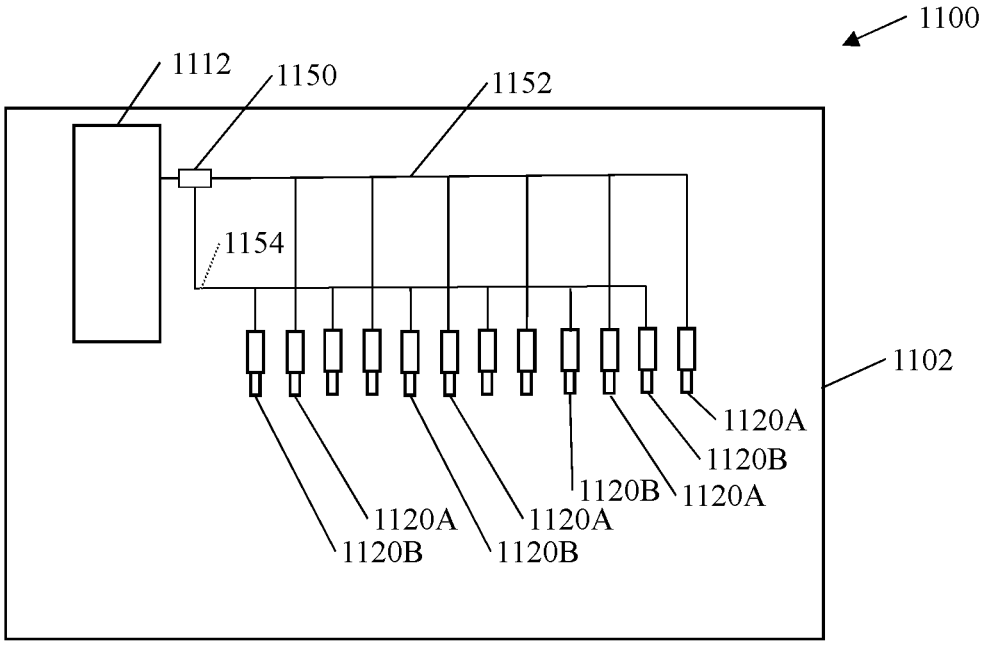
FIG. 11 is a schematic view of another exemplary embodiment of a portion of a wet-on-demand dispenser.

FIG. 11 is an schematic view of an exemplary embodiment of a system for controlling the amount of fluid dispensed on the substrate to be dispensed. Wet-on-demand dispenser 1100 includes a housing 1102 and a container 1112 located within the housing 1102. Wet-on-demand dispenser 1100 includes a plurality of wetting tips 1120A, 1120B. In this exemplary embodiment, wetting tips 1120A are connected to header 1152 and wetting tips 1120B are connected to a second header 1154. While two headers are shown, more than two headers may be utilized. Headers 1152 and 1154 are in fluid communication with controller 1150, which is in fluid communication with container 1112. Controller 1150 may control the volume of fluid communicated to headers 1152 and 1154. In some embodiments, controller 1150 allows fluid to flow into a single header 1152 or 1154 if a first degree of wetness is desired in the substrate to be dispensed and allows fluid to flow in both headers if a second degree of wetness is desired. In some embodiments, wetting tips 1120A are arranged with wetting tips 1120B therebetween. In some embodiments, a selector switch (not shown) is provided for selecting the desired wetness of the substrate to be dispensed. In some embodiments, the selector switch (not shown) is located on the housing 1102.

In some embodiments, one or more heaters (not shown) are provided. In some embodiments, wetting tips 220 are heated. In some embodiments, the container(s) is heated. In some embodiments, the interior of the housing is heated.

Figure 12:
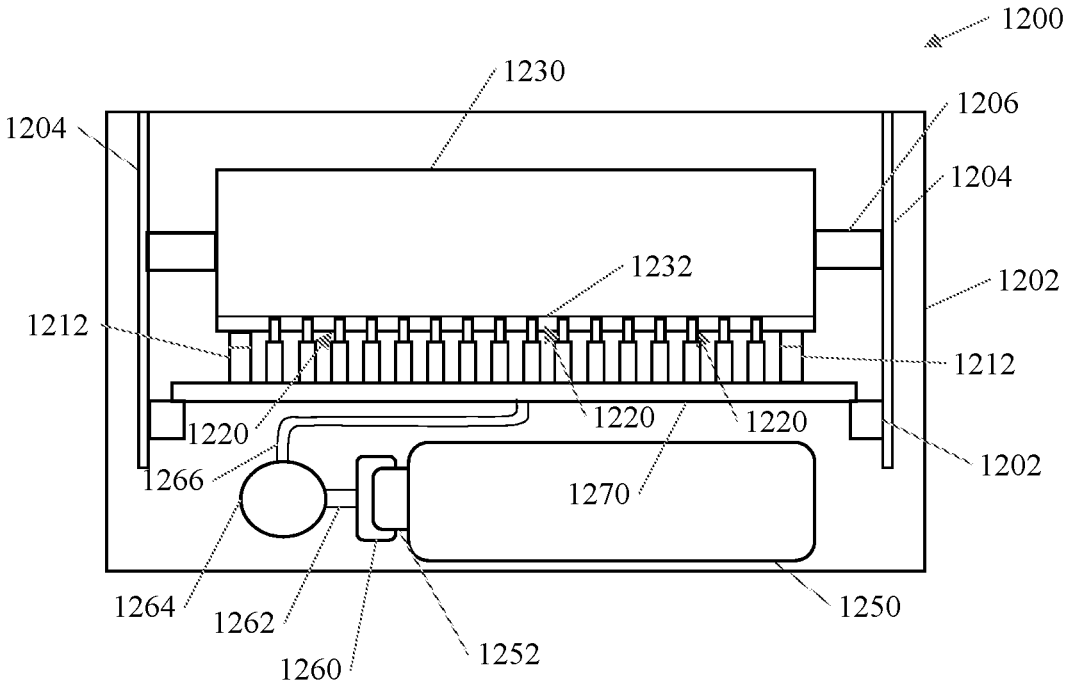
FIG. 12 is a simplified view of another exemplary embodiment of a wet-on demand dispenser.

FIG. 12 illustrates another exemplary embodiment for a wet-on-demand dispenser 1200. Dispenser 1200 includes a housing 1202. Located within the housing is support members 1204. A roll of substrate 1230 is positioned on a roller 1206 that is secured to support members 1204. In this exemplary embodiment, the roll of substrate 1230 is secured to the support members 1204 in a manner that allows the roll of substrate to float vertically. Wet-on-demand dispenser 1200 includes a header 1270 supported on support members 1202 that are secured to support members 1204. Header 1270 is in fluid communications with one or more wetting tips 1220. In this exemplary embodiment, the movable valve members of the wetting tips 1220 are biased to their normally closed position by a biasing member (not shown) such as a spring. Preferably, the biasing members require minimum contact pressure on the tips to allow the movable valves to open. Located between header 1270 and the roll of substrate 1230 is tow or more spacing members 1212. Spacing members 1212 may include one or more rollers (not shown). The spacing members 1212 may be used to ensure that the sheet of substrate that is being pulled from the roll of substrates 250 is always in a desired position with respect to the wetting tips 1220. A removable and replaceable refill unit 1250 is located in the dispenser housing. The removable and replicable refill unit 1250 has a neck 1252. Neck 1252 is received by receiver 1260. One or more valves (not shown) may be included in or near the neck 1252 to prevent fluid from flowing out of the refill nit 1250 when the refill unit 1250 is not connected to the receiver 1260. Similarly, receiver 1260 may have one or more vales (not shown) associated therewith to prevent fluid from flowing out of the dispenser 1200 when the refill unit 1250 is removed from the dispenser. When the refill unit 1250 is inserted into receiver 1260, any valves are moved to an open position to allow fluid to flow out of refill unit 1250. An inlet conduit 1262 extends from the receiver 1260 to a pump 1264. An outlet conduit extends from the pump 1264 outlet to header 1270. In some embodiments, pump 1264 maintains a constant pressure in header 1270 and when one or more movable valves (not shown) in the one or more wetting tips 1220 open, fluid may flow out. In such an embodiment, the dispenser may include a pressure sensor located downstream of pump 1264. A processor (not shown) may receive the pressure signal and cause pump 1264 to turn on and off base upon a desired pressure.

In some embodiments, a hand or motion sensor (not shown), such as, for example, an infrared (IR) sensor may be used to detect the presence of a user desiring a moistened substrate. If the dispenser 1200 is a manual dispenser, the pump 1264 may turn on only when the IR sensor detects a user. In some embodiment, if the dispenser is a manual dispenser, the processor may determine that a sheet of substrate is being dispense, by for example, detecting rotation of the shaft 1206 and energize the pump 1264. In some of these embodiments, the wetting tips 1220 do not require movable valve members because the pump is only turned on when there substrate is being pulled from the dispenser 1200. Similarly, if the dispenser 1200 is a touch free dispenser, the processor may case the pump 1264 to be energized only during the period of time that a sheet of substrate is being removed from the dispenser.

Figure 13:
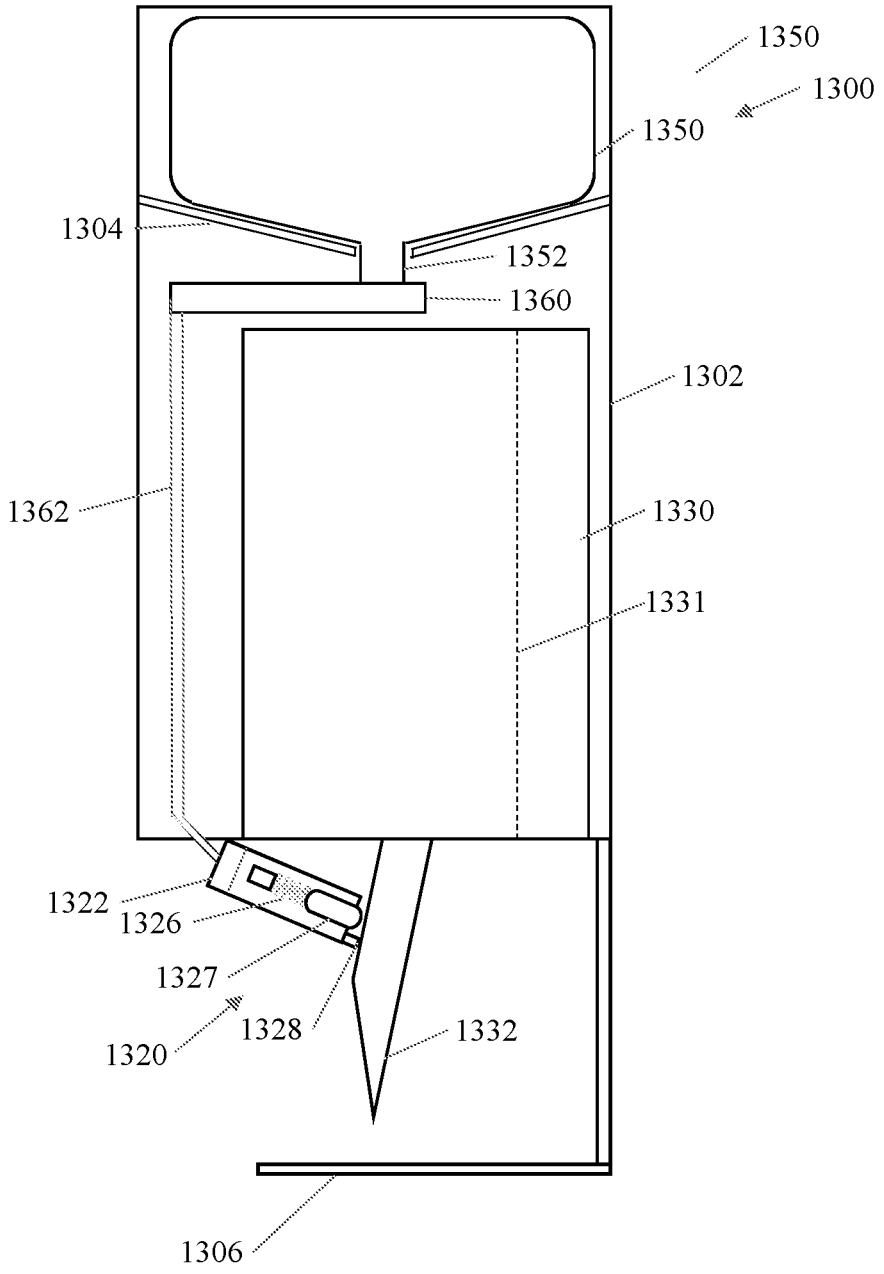
FIG. 13 is a simplified view of another exemplary embodiment of a wet-on demand dispenser.

FIG. 13 illustrates another exemplary embodiment of a wet-on-demand dispenser 1300. Wet-on-demand dispenser 1300. Wet-on-demand dispenser 1300 includes a housing 1302. Located in the housing is a roll of substrates 1330. In this exemplary embodiment roll of substrates 1330 may be a roll of wipes. The roll of substrates has a plurality of sheets separated by perforation lines 1331. In this exemplary embodiment, a sheet 1332 is being pulled from the center of the roll of substrates 1330 out of an opening (not shown) in the bottom of the wet-on-demand dispenser 1300. Wet-on-demand dispenser 1300 includes a reservoir 1350. Reservoir 1350 may be refillable though an opening (not shown) in the top of the housing 1302. In some embodiments reservoir 1350 is removable and replaceable. On or more valves may be incorporated in the neck 1352 or proximate neck 1352 of reservoir 1350 as described in more detail above. Neck 1352 is received by receiving member 1360. Receiving member 1360 forms a seal with neck 1352 to prevent fluid from leaking. A conduit 1362 extends from receiving member 1360 to one or more wetting tips 1320. In this exemplary embodiment, the one or more wetting tips include a housing 1322, a movable valve member 1327, which is biased to the closed position by a biasing member 1236; and an optional diffuser 1328, which may also prevent dripping. In addition, attached to the housing 1302 is a drip shield 1306.

During operation, a substrate sheet 1332 is pulled downward and outward causing the sheet of substrate 1332 to push against movable valve member 1327, which allows fluid to flow out of the wetting tip 1320 and onto the substrate sheet 1328. Thus, as the substrate sheet 1332 is pulled out of wet-on-demand dispenser 1300, the substrate sheet 1332 is wetted. Once the end of substrate sheet 1332 is far enough outside of wet-on-demand dispenser 1300, the substrate sheet separates from the trailing substrate sheet 1332 by tearing at the perforation line between the substrate sheets 1332. In this exemplary embodiment, the substrate sheets 1332 is pulled out from the center of the roll of substrates in contrast to the above exemplary embodiments where the substrate sheets are pulled out from the outside of the roll of substrates.

Select components, such as, for example, switches, heaters, rollers, gears, processors, sensors, controllers and the like that have been described with respect to one or more embodiments may be combined with the other embodiments.

In a preferred embodiment, the dispenser is a dispenser for dispensing wet on demand wipes. The wipe can take a variety of forms. For example, the wipe can be made of a variety of materials, have a variety of lengths and/or widths. Non-limiting examples of suitable materials include polypropylene, microfiber, polyester, viscose, non-woven fiber, or any other suitable materials and combination thereof. The wipe can be configured in a variety of shapes and sizes. The connected wipes can be separable. For example, separable wipes may be divided into individual sheets by lines of weakness, such as for example, a perforation line or an area of reduced thickness. In other embodiments, however, the connected wipes may not be divided by lines of weakness, but may be separable by cutting or tearing. Thus, a system implementing the method may have structure to facilitate cutting or tearing the connected wipes, such as for example, a blade or sharp edge.

The liquid used to moisten the wipe can be a variety of different liquids. In some exemplary embodiments, the liquid in the wipe can be water or water with additional additives. For example, in one exemplary embodiment, the liquid can be an alcohol, such as ethyl alcohol (ethanol) or isopropanol alcohol, diluted with water. Exemplary embodiments include formulations that contains water and ethanol mixtures. These formulations may contain up to about 70% ethanol, including up to about 60% ethanol, including up to about 50% ethanol, including up to about 40% ethanol, including up to about 30% ethanol, including up to about 20% ethanol, including up to about 10% ethanol, including up to about 3% ethanol, including up to about 0.75% ethanol. In one exemplary embodiment, the liquid is tap water, however, the liquid can be distilled water, deionized water, tap water, filtered water, saline, water with acidic properties, and water with basic properties. In some exemplary embodiments the formulation includes water, alcohol, and one or more additional additives. Other exemplary additives may include quaternary ammonium group, such as, for example, benzalkonium chloride.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome swivel nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A wet-on-demand dispenser comprising:
- a housing;
- a container for holding a fluid;
- a plurality of wetting tips;
  - each wetting tip having
    - a housing; and
    - a moveable valve member;
  - wherein at least a portion of the moveable valve member moves within the housing;
  - wherein the moveable valve member is in a normally closed position preventing fluid from flowing through;
  - wherein the moveable valve member moves to an open position to allow fluid to flow through;
- one or more conduits placing the plurality of wetting tips in fluid communication with the container;
- a roll of substrate containing one or more sheets of substrate;
- wherein when the one or more sheets of substrate are dispensed from the dispenser, the one or more sheets of substrate contact the movable valve members and move the movable valve members to their open position to allow fluid to flow out of the one or more wetting tips.

2. The dispenser of claim 1 wherein the container is removable.

3. The dispenser of claim 1 further comprising on or more diffusers for diffusing fluid flowing out of the one or more wetting tips.

4. The dispenser of claim 1 further comprising one or more rollers for directing the substrate.

5. The dispenser of claim 1 wherein a first number of wetting tips are utilized to wet the substrate to a first degree of wetness and where a second number of wetting tips are utilized to wet the substrate to a second degree of wetness, wherein the second degree of wetness is wetter than the first degree of wetness.

6. The dispenser of claim 1 further comprising a heater for heating the fluid and/or a sheet of substrate.

7. The wet-on-demand dispenser of claim 1 wherein the movable valve member is biased by a spring to the closed position.

8. The wet-on-demand dispenser of claim 1 wherein the moveable valve member is located further in the housing when moving to the open position.

9. The wet-on-demand dispenser of claim 1 wherein the moveable valve member pivots with respect to the housing when moving to the open position.

10. The wet-on-demand dispenser of claim 1 comprising a second container and a mixing chamber, wherein a first fluid flows from the first container to the mixing chamber and a second fluid flows from the second container to the mixing chamber; and wherein the mixture of the first fluid and the second fluid flows to the plurality of wetting tips.

11. The dispenser of claim 10 wherein the second container is removable.

12. A wet-on-demand dispenser comprising:
a housing;
a first container for holding a first fluid;
a second container for holding a second fluid;
a mixing chamber for mixing the first fluid and the second fluid;
a header;
a plurality of wetting tips;
each wetting tip having
a housing; and
a moveable valve member;
wherein at least a portion of the moveable valve member moves with respect to the housing;
wherein the moveable valve member is in a normally closed position preventing fluid from flowing through;
wherein the moveable valve member moves to an open position to allow fluid to flow through;
wherein the header places the mixing chamber in fluid communication with the plurality of wetting tips;
wherein when the one or more sheets of substrate are dispensed from the dispenser, the one or more sheets of substrate contact the movable valve members and move the movable valve members to their open position to allow fluid to flow out of the one or more wetting tips.

13. The dispenser of claim 12 wherein the volume of fluid flowing through the plurality of wetting tips is proportional to the amount of movement of the moveable valve members.

14. The dispenser of claim 12 wherein the first container holds a concentrate and the second container holds a diluent.

15. The dispenser of claim 12 further comprising one or more diffusers.

16. A wet-on-demand dispenser comprising:
a housing;
a first container for holding a first fluid;
a plurality of wetting tips;
each wetting tip having
a housing; and
a moveable valve member;
wherein the plurality of wetting tips are in fluid communication with the first container;
wherein at least a portion of the moveable valve member moves within the housing;
wherein the moveable valve member is in a normally closed position preventing fluid from flowing through;
wherein the moveable valve member moves to an open position to allow fluid to flow through;
one or more conduits placing the plurality of wetting tips in fluid communication with the container;
a holder for receiving a roll of substrate;
wherein when one or more sheets of substrate are dispensed from the dispenser, the one or more sheets of substrate contact the movable valve members and physically move the movable valve members to their open position to allow fluid to flow out of the one or more wetting tips.

17. The dispenser of claim 15 wherein the moveable valve member pivots.

18. The dispenser of claim 15 wherein the moveable valve member moves linearly with respect to the housing.

19. The dispenser of claim 15 wherein the first container is located above the plurality of wetting tips.

20. The dispenser of claim 15 further comprising a second container and a mixing chamber.

* * * * *